US011781341B1

(12) United States Patent
Timothy

(10) Patent No.: US 11,781,341 B1
(45) Date of Patent: Oct. 10, 2023

(54) DOUBLE LATCH DUAL ACTION GRAVITY LATCH

(71) Applicant: NATIONWIDE INDUSTRIES, INC., Tampa, FL (US)

(72) Inventor: E. Erik Timothy, Apollo Beach, FL (US)

(73) Assignee: NATIONWIDE INDUSTRIES, INC., Tampa, FL (US)

( * ) Notice: Subject to any disclaimer, the term of this patent is extended or adjusted under 35 U.S.C. 154(b) by 113 days.

(21) Appl. No.: 17/300,744

(22) Filed: Oct. 15, 2021

Related U.S. Application Data

(60) Provisional application No. 63/204,636, filed on Oct. 16, 2020.

(51) Int. Cl.

| | |
|---|---|
| ***E05B 15/10*** | (2006.01) |
| ***E05B 15/00*** | (2006.01) |
| ***E05C 3/30*** | (2006.01) |
| ***E05B 65/00*** | (2006.01) |

(52) U.S. Cl.
CPC ..... *E05B 15/0093* (2013.01); *E05B 65/0007* (2013.01); *E05C 3/30* (2013.01)

(58) Field of Classification Search
CPC .... E05B 15/0093; E05B 17/042; E05B 17/20; E05B 17/2007; E05B 17/2015; E05B 17/203; E05B 17/2038; E05B 65/0007; E05B 13/00; E05B 13/002; E05B 13/004; E05C 3/00; E05C 3/006; E05C 3/12; E05C 3/14; E05C 3/16; E05C 3/162; E05C 3/24; E05C 3/26; E05C 3/30; E05C 3/40

See application file for complete search history.

(56) References Cited

U.S. PATENT DOCUMENTS

| | | | | |
|---|---|---|---|---|
| 6,058,747 A * | 5/2000 | Doyle | E05B 13/105 292/135 |
| 6,513,351 B2 * | 2/2003 | Clark | E05B 15/0093 70/135 |
| 7,201,030 B2 * | 4/2007 | Timothy | E05B 65/0007 70/135 |
| 9,771,740 B2 * | 9/2017 | Karcz | E05B 65/06 |

(Continued)

FOREIGN PATENT DOCUMENTS

| | | | |
|---|---|---|---|
| EP | 1348825 A1 * | 10/2003 | E05B 17/042 |

*Primary Examiner* — Christine M Mills
*Assistant Examiner* — Christopher F Callahan
(74) *Attorney, Agent, or Firm* — Arthur W. Fisher, III

(57) ABSTRACT

A double lock, dual action gravity latch device to secure a gate in a closed position comprising a latch assembly including a pivotal latch member movable between a latched and unlatched position, a keeper assembly including a striker pin to maintain the gate in the closed position when the pivotal latch member in the latched position, a latch lock assembly including a lock assembly with a first lock and a second lock each independently movable between a locked position and an unlocked position disposed on opposite sides of the gate to selectively move a latch blocking assembly from a latch blocking position to a latch unblocking position when either the first lock or second lock is moved from the locked position to the unlocked position and move the latch blocking assembly from the latch unblocking position to the latch blocking position when the unlocked lock is moved from the unlocked position to the locked position.

2 Claims, 19 Drawing Sheets

(56) References Cited

U.S. PATENT DOCUMENTS

| | | | | |
|---|---|---|---|---|
| 9,803,396 | B2 * | 10/2017 | Timothy | E05B 65/0007 |
| 2010/0123321 | A1 * | 5/2010 | Timothy | E05C 3/30 70/91 |

* cited by examiner

DOUBLE LATCH DUAL ACTION GRAVITY LATCH

CROSS REFERENCE

This application claims priority of Provisional Application, Ser. No. 63/204,636 filed Oct. 16, 2020.

BACKGROUND OF THE INVENTION

Field of the Invention

A double lock, dual action gravity latch device for use with a gate operable from either side of the gate to release a pivotal gravity latch permitting the gate to be opened.

Description of the Prior Art

Numerous gate latches have been designed to block or secure openings in fences of other inclosing barriers. Such designs include both gravity operated latches and magnetic latch devices.

U.S. Pat. No. 9,803,396 relates to dual action gravity latch device to secure a gate in a closed position comprising a latch assembly including a pivotal latch member movable between a latched and unlatched position, a keeper assembly including a striker pin to maintain the pivotal latch member in the latched position. A first and second actuator assembly each movable between a first configuration and a second configuration and disposed on opposite sides of the gate to selectively engage the pivotal latch member such that when the second actuator assembly is in the first configuration and the first actuator assembly in the second configuration the pivotal latch member is in the unlatched position to allow the gate to be opened and when the first actuator assembly is in the first configuration and the second actuator assembly is in the second configuration the pivotal latch member is in unlatched position to allow the gate to be opened.

U.S. 2010/0244463 describes a magnetic latch system including a latch assembly and a keeper assembly. The keeper assembly includes a magnetically attractable keeper pin. The latch assembly includes two base assemblies, one on either side of a movable gate element. The base assembly adjacent the keeper assembly includes a magnet and an internal actuator which is arranged to engage the keeper pin to move it away from the permanent magnet when one of the latch handles is manually rotated. The system may also include a locking system in one or both handles to fix the internal actuator in a locked position so that it cannot engage the keeper pin.

U.S. Pat. No. 8,646,815 discloses a A gate latch system including a button assembly, a latch assembly, and a keeper assembly. The gate latch assembly can be opened from the side of the gate opposite the latch through the use of a spindle extending from a button assembly on one side of the gate to a latch assembly located on the opposite side of the gate and which includes a latch retention member. The latch assembly and button assembly are configured so that the spindle extends from the button assembly to the latch assembly through the gate opening such that there is no need to make a hole through the gate and/or covering to accommodate the spindle.

U.S. Pat. No. 7,201,030 describes a gate lock device with front and rear units mounted on opposite sides of a structure associated with the gate and against which the gate closes. A gravity latch, displaceably mounted in the housing of the front unit, is engageable with a keeper pin. The front and rear units are provided with key-operated locks which are operable to lock and unlock the gravity latch. The rear unit includes an axially displaceable actuator operable to unlock the gravity latch when the key-operated locks are unlocked.

U.S. Pat. No. 8,646,815 relates to a gate latch system including a button assembly, a latch assembly, and a keeper assembly. The gate latch assembly can be opened from the side of the gate opposite the latch through the use of a spindle extending from a button assembly on one side of the gate to a latch assembly located on the opposite side of the gate and which includes a latch retention member. The latch assembly and button assembly are configured so that the spindle extends from the button assembly to the latch assembly through the gate opening such that there is no need to make a hole through the gate and/or covering to accommodate the spindle.

U.S. Pat. No. 6,058,747 discloses a gravity latch comprising a housing for pivotally mounting a closure member and a cylinder lock located below the closure member. A remote actuator is mounted on the opposite side of the fence from the housing for moving the closure member. The remote actuator may include a lock so that the actuator cannot be operated.

U.S. Pat. No. 6,513,351 discloses a gravity latch which includes a housing for pivotally mounting a closure member and a cylinder lock situated below the closure member. U.S. Pat. No. 6,513,351 also discloses a remote actuator mounted oh the opposite side of the fence from which the housing is located. In addition, the remote actuator may include a cylinder lock which is connected through a gearing system to allow for locking the closure member from the remote location.

Examples of gravity operated or similar latch devices or assemblies are found in U.S. Pat. No. 2,767,007; U.S. Pat. No. 3,040,555; U.S. Pat. No. 3,601,799; U.S. Pat. No. 3,705,505; U.S. Pat. No. 4,073,520; U.S. Pat. No. 4,083,591; U.S. Pat. No. 2,284,370; US 2007/0175250 and US 2010/0148523.

Additional examples of magnetic latch devices can be found in US 8,376,421; US 5,362,116; US 5,664,769; US 7,044,511; US 7,100,405; US 5,114,195; U.S. Pat. No. 5,490,698; U.S. Pat. No. 5,823,026; U.S. Pat. No. 6,155,616; U.S. Pat. No. 6,666,435 and U.S. Pat. No. 7,390,035.

While some of the prior art may contain some similarities relating to the present invention, none of them teach, suggested or include all of the advantages and unique features of the invention disclosed hereafter.

SUMMARY OF THE INVENTION

The present invention relates to a dual action gravity latch device comprising a latch assembly including a pivotal latch member comprising an upper hook shaped member mounted to a fence and a keeper or striker assembly including a striker pin attached to a gate disposed to selectively engage the pivot latch member.

The dual action gravity latch device further includes a first actuator and a second actuator each to selectively to move the pivotal latch member from a first position or latched position to a second position or unlatched position to allow the gate to be opened.

The latch assembly further comprises a latch blocking assembly moveable between a latch blocking position and a latch unblocking position to selectively block and unblock movement of the pivotal latch member to permit the gate to be opened.

This Summary is not intended to describe essential features of the claimed subject matter nor is it intended to limit the scope of the claimed subject matter. To the contrary, this Summary merely outlines various concepts and features that are developed in the Detailed Description.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
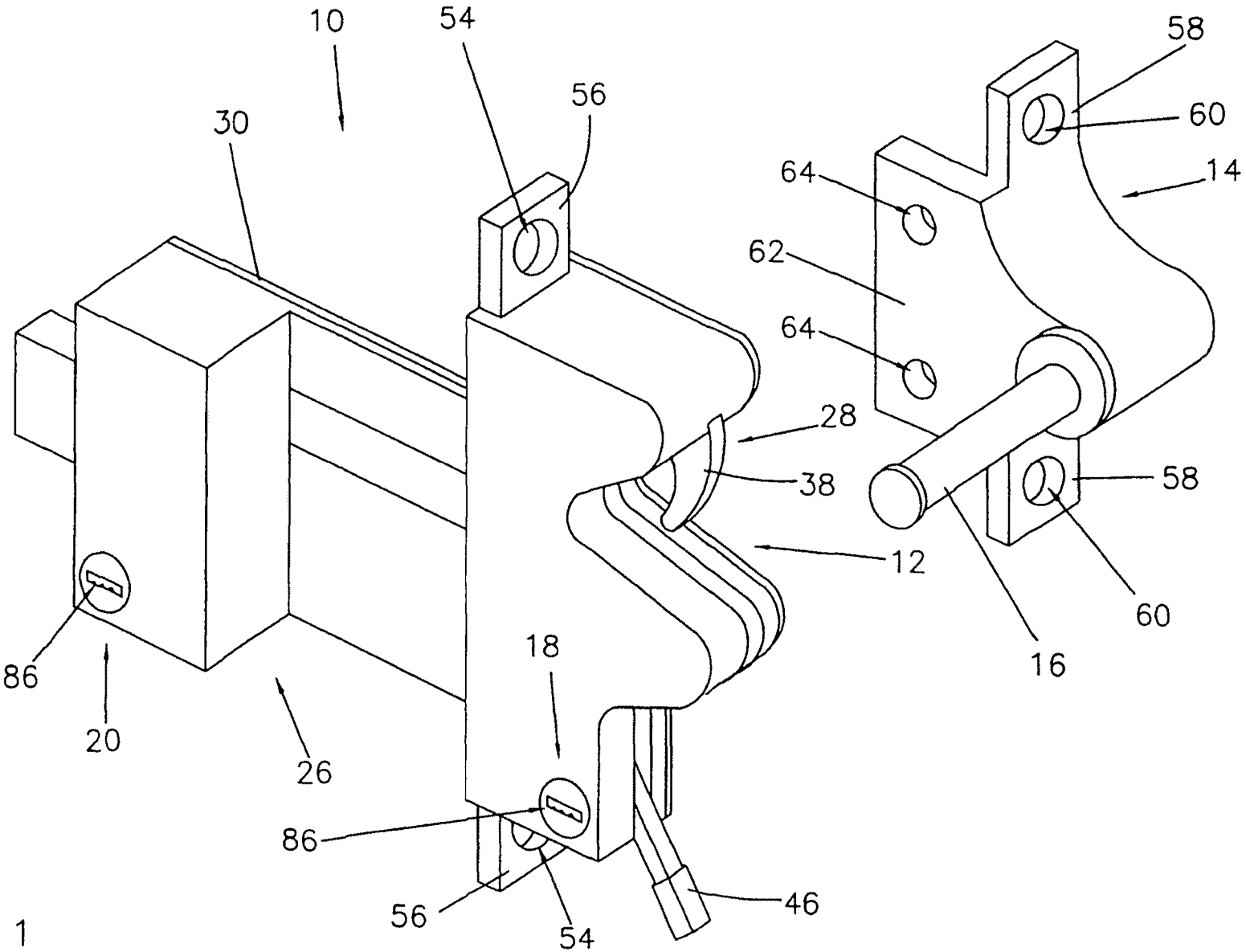
FIG. 1 is a perspective view of the double lock, dual action gravity device of the present invention.

As shown in FIG. 1, the present invention relates to a double lock, dual action gravity latch device comprising a latch assembly generally indicated as 10 including a pivotal latch member generally indicated as 12 mounted to a fence or door jam (not shown) and a keeper assembly generally indicated as 14 including a striker pin 16 attached to a gate or door (not shown) to selectively engage the pivotal latch member 12 to selectively maintain the gate or door (not shown) in the closed position.

Figure 2:
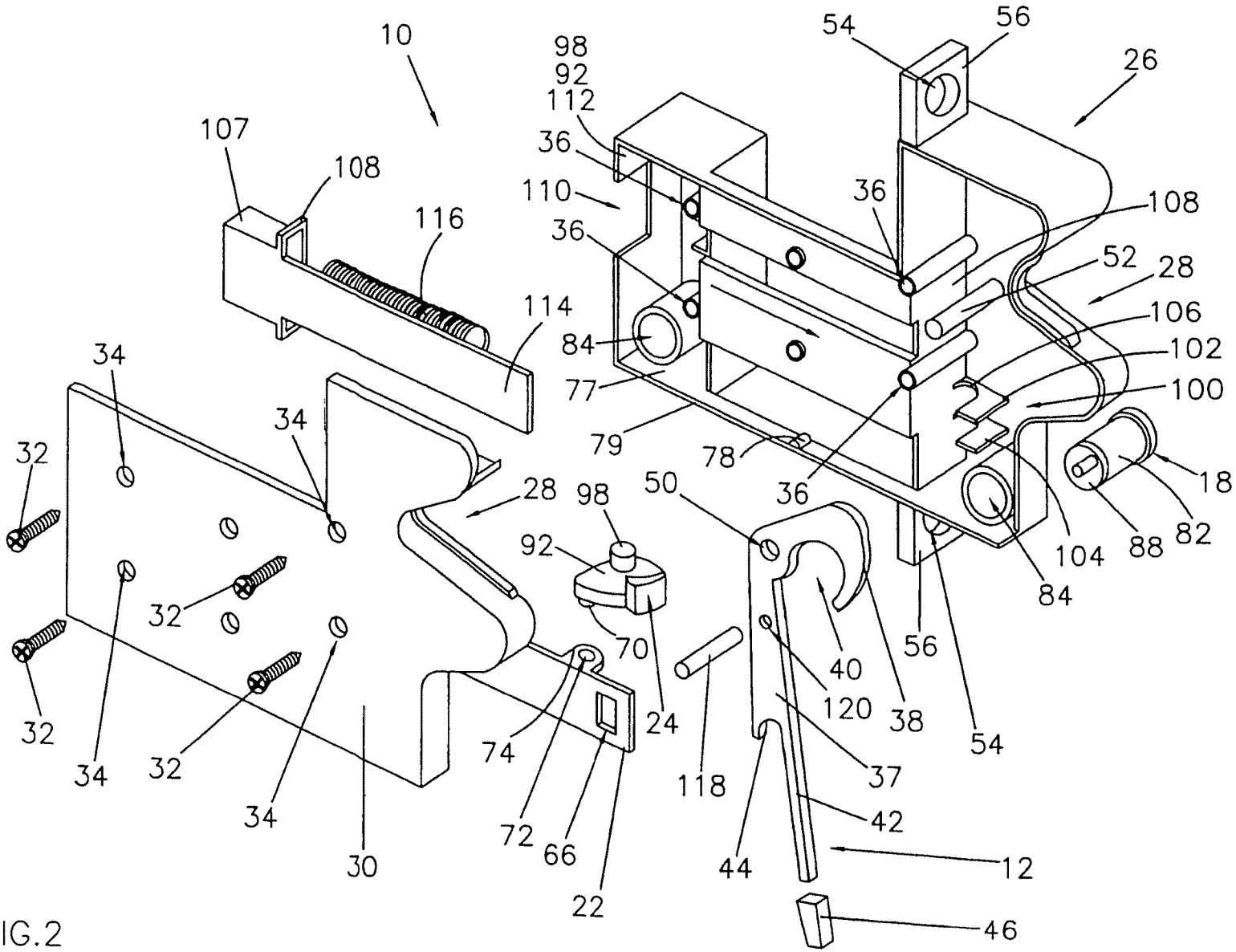
FIG. 2 is an exploded perspective view of the latch assembly of the double lock, dual action gravity latch device of the present invention.

As best shown in FIGS. 1 and 2, the latch assembly 10 comprises a latch lock assembly including a lock assembly with a first or proximal lock generally indicated as 18 and a second or distal lock generally indicated as 20 each independently movable between a locked position and an unlocked position disposed on the proximal side and distal side of the gate (not shown) respectively and a lock subassembly including a lock bar or member generally indicated as 22 and a lock cam or latch stop generally indicated as 24 selectively movable between a locked position and an unlocked position to selectively block movement of the pivotal latch member 12 from the latched position to the unlatched position when the lock subassembly is in the locked position.

As shown in FIGS. 1 and 2, the latch assembly 10 further comprises a latch housing generally indicated as 26 housing both the first or proximal lock 18 and the second or distal lock 20 in a single enclosure includes a keeper receiver opening 28 to receive the striker pin 16 of the keeper assembly 14 when the gate (not shown) is closed and a side plate generally indicated a 30 secured to the latch housing 26 by a plurality of fasteners each indicated as 32 extending through corresponding apertures 34 formed in the side plate 30 and into corresponding apertures or recesses 36 formed in the latch housing 26.

Figure 16:
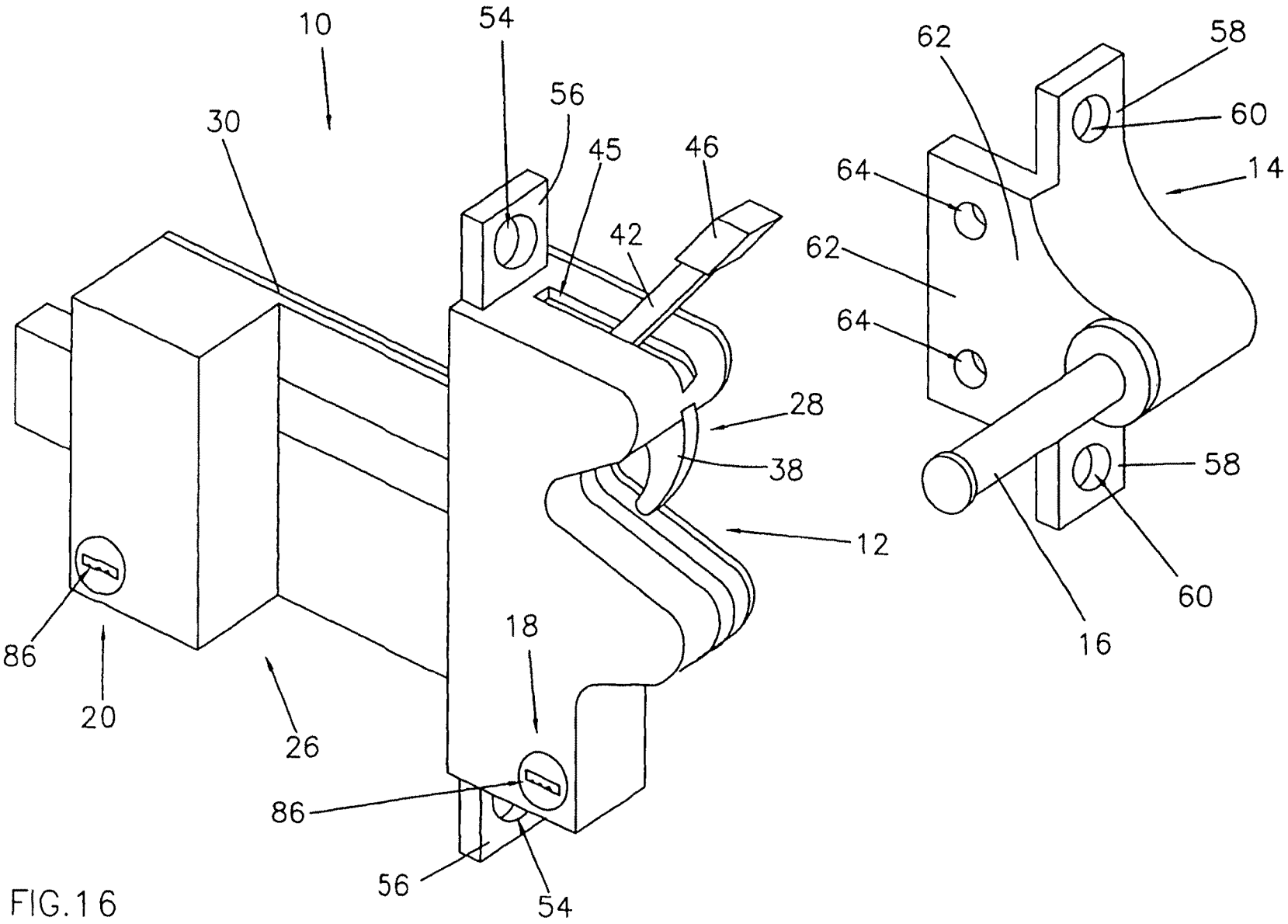
FIG. 16 is a perspective view of an alternate embodiment of the first latch member and knob of the double lock, dual action gravity latch device of the present invention.
Figure 17:
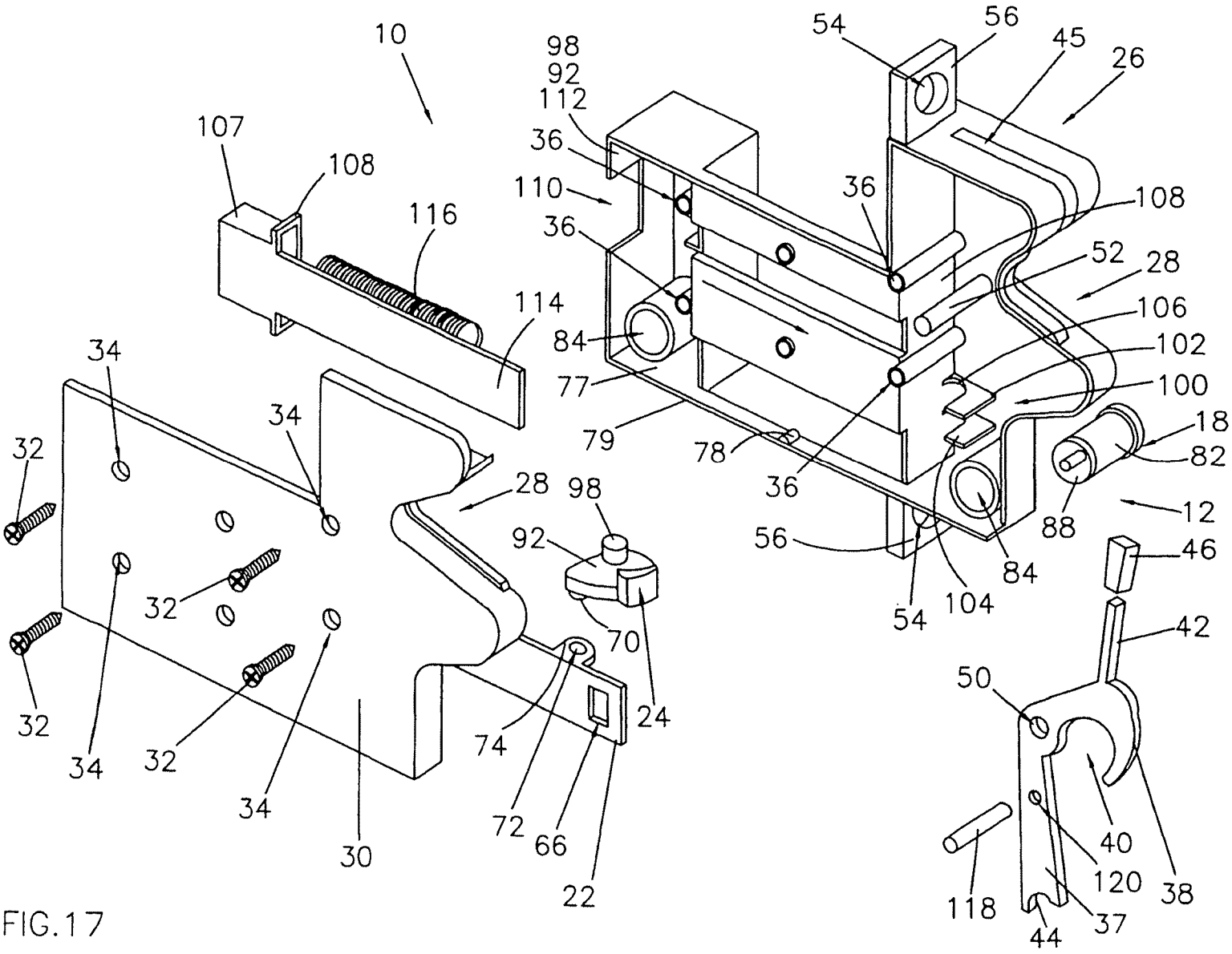
FIG. 17 is an exploded perspective view of the alternate embodiment of the first latch member and knob of the double lock, dual action gravity latch device of the present invention.

The pivotal latch member 12 comprises a body or substantially flat member 37 having an upper hook member 38 including a striker pin recess 40 on the upper portion thereof disposed within the keeper receiver opening 28, a first latch member 42 extending downward from the lower proximal portion of the body or substantially flat member 37 and a second latch member 44 formed on the lower distal portion of the body or substantially flat member 37. A latch knob 46 may be formed on the lower portion of the first latch member 42. The pivotal latch member 12 is pivotally mounted within the latch housing 26 on a latch mounting pin 48 extending through a pivot aperture 50 formed on the upper portion of the pivotal latch member 12 and into a mounting pin recess 52. The pivotal latch member 12 is normally disposed in the latched position due to gravity. Alternately, the first latch member 42 and knob 46 may be formed on the upper portion of the pivotal latch member 12 as shown in FIGS. 16 and 17 where the first latch member 42 extends upwardly through formed in the latch housing 28.

The latch assembly 10 is affixed to the fence (not shown) with fasteners (not shown) passing through holes 54 formed through an upper and lower mounting flange each indicated as 56.

As shown in FIG. 1, the keeper assembly 14 is affixed to the gate (not shown) by an upper and lower front attachment flange each indicated as 58 including holes 60 and side attachment flanges 62 including holes 64 receive fasteners such as screws (not shown).

The latch lock assembly comprises the lock assembly including the first or proximal lock 18 and the second or distal lock 20 together with the lock subassembly including the lock bar or member 22 having a proximal bar actuator aperture or recess 66 and a distal bar actuator aperture or recess 68 formed on proximal end portion and distal end portion of the lock bar or member 22 respectively with the lock cam or latch stop 24 pivotally mounted on the lock bar or member 22 by a pivot pin 70 extending through a pivot opening or recess 72 formed in or through a cam mounting flange 74. The pivot opening or recess 72 and the cam mounting flange 74 may be formed on each end portion of the lock bar or member 62 to allow for a left hand or right hand gate mount.

Figure 18:
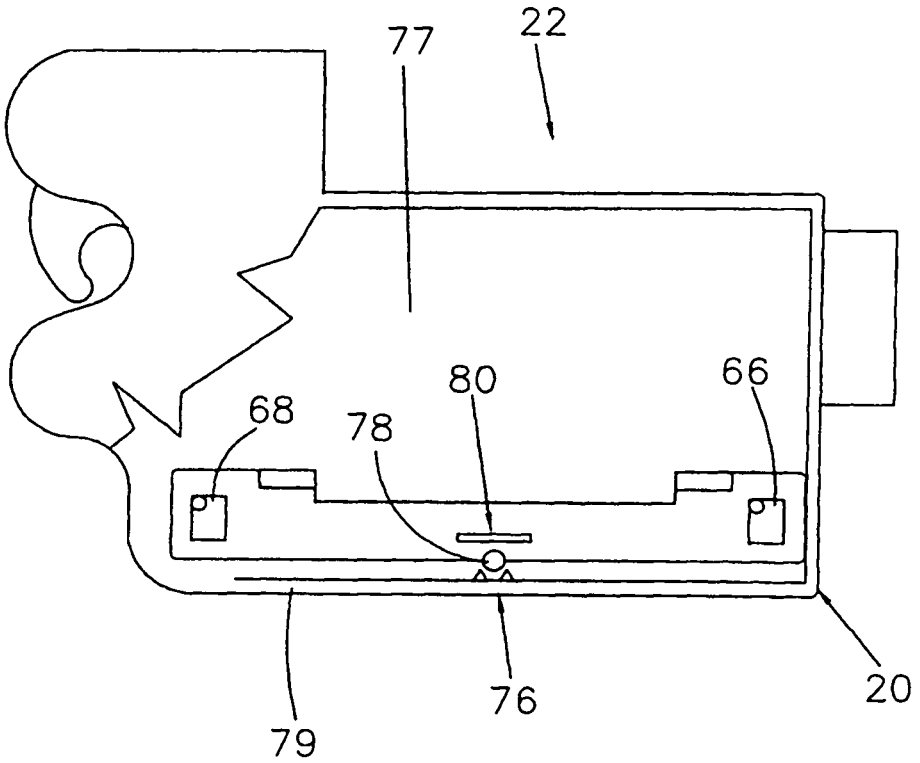
FIG. 18 is a side view of an alternate embodiment of the stabilizer of the double lock, dual action gravity latch device of the present invention.

The lock bar or member 22 further includes a stabilizer such as a sawtooth recess or cut out portion 76 formed in the lower edge of the lock bar or member 22 to engage a ridge or protrusion 78 formed on the inner surface 77 of the lower or bottom wall 79 of the latch housing 26 to assist in maintaining the alignment of the lock bar or member 62 relative to the first or proximal lock 18 and the second or distal lock 20 during linear movement of the lock bar or member 22 between the locked and unlocked position. In addition, a slot or groove 80 may be formed in the lock bar or member 22 above the sawtooth recess or cut out portion 76 to allow for resilient flexing of the engagement between the sawtooth recess or cut out portion 76 and the ridge or protrusion 78. Alternately, as shown in FIG. 18 the sawtooth recess or cut out portion 76 may be formed on the upper surface 77 of the lower or bottom wall 79 of the latch housing 26; while, the ridge or protrusion 78 is formed on the lower portion of the lock bar or member 22.

The first or proximal lock 18 and the second or distal lock 20 each comprises a three (3) position cylinder or lock 82 disposed within a corresponding sleeve 84 and having a keyway or key slot 86 formed on the outer portion thereof to receive a key (not shown) therein to rotate the cylinder lock 80 between the three (3) positions—unlocked position, locked position and neutral position. A bar actuator pin or member 88 extends outwardly from the inner portion of each cylinder or lock 82 to engage the inner periphery or perimeter 90 of the corresponding bar actuator aperture or recess 66 to move or slide the lock bar or member 22 linearly rotating the lock cam or latch stop 24 between the locked and unlocked position as the key (not shown) is rotated in the cylinder or lock 82.

As shown in FIGS. 2 through 9, the lock cam or latch stop 24 comprises the cam mounting pin 70 extending downward from the lower surface of a substantially flat cam body or plate 92, an arcuate cam member 94 including an angled or inclined surface 96 extending upward from the upper surface of the substantially flat cam body or plate 92 and a cam mounting pin 98 opposite the arcuate cam member 94.

As shown in FIG. 2, when the double lock, dual action gravity latch is fully assembled the substantially flat cam body or plate 92 is disposed or located in a slot 100 formed between an upper cam retainer plate 102 and a lower cam retainer plate 104 each includes a concave recess 106 to receive a portion of the cam mounting pin 98 extending outward from an inner wall 108.

As shown in FIG. 2, the first latch actuator comprises the latch knob 46 and the first latch member 42 of the pivotal latch member 12 to move the pivoted latch member 12 from the latched position to the unlatched position when the latch assembly 10 is in the unlocked position formed in the rear or back wall 112 of the latch housing 26.

As shown in FIG. 2, the second actuator assembly comprises a plunger 107 partially retained within the latch housing 26 by an outer retainer flange 108 disposed inside the periphery of an outer plunger opening 110, an elongated actuator bar 114 extending inwardly from the outer retainer flange 102 and the plunger 107 and a bias or spring 116 partially disposed within the latch housing 26 to normally maintain the second actuator assembly in the first position. An actuator pin 118 extends through a mounting hole 120 formed on the upper portion of the pivot latch member 12 to engage the inner portion of the elongated actuator bar 114 when the plunger 107 is moved 10 inwardly against the force of the bias or spring 116 when the latch assembly is in the unlocked position to pivot the pivot latch member 12 to the open position allowing the gate to be opened. When the plunger 107 released, the bias or spring 116 returns the second actuator to the first or extended position allowing the pivoted latch member 12 to return to the first position.

Figure 14:
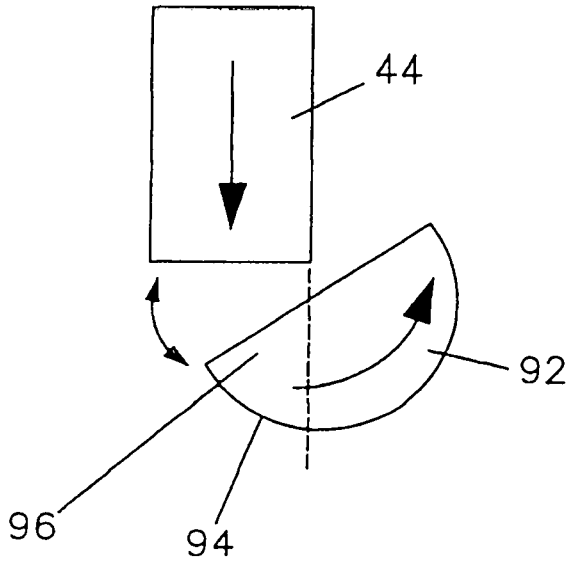
FIG. 14 is a top schematic view of the pivotal latch member and cam member or latch stop of the double lock, dual action gravity latch device of the present invention with the cam member or latch stop in the locked position.

As shown in FIGS. 5, 6, 12 and 14, when the lock assembly and lock subassembly of the latch lock assembly are in the locked position movement of the pivotal latch member 12 from the latched position to the unlatched position is blocked as the second latch member 44 formed on the lower distal portion of the body or substantially flat member 37 engages or strikes the 20 angled or inclined surface 96 of the arcuate cam member 94 of the lock cam or latch stop 24 at an inner obtuse angle. As shown in FIG. 14, the second latch member 44 engages the angled or inclined surface 96 pushing or forcing the lock cam or latch stop 24 away from the unlocked position.

Figure 3:
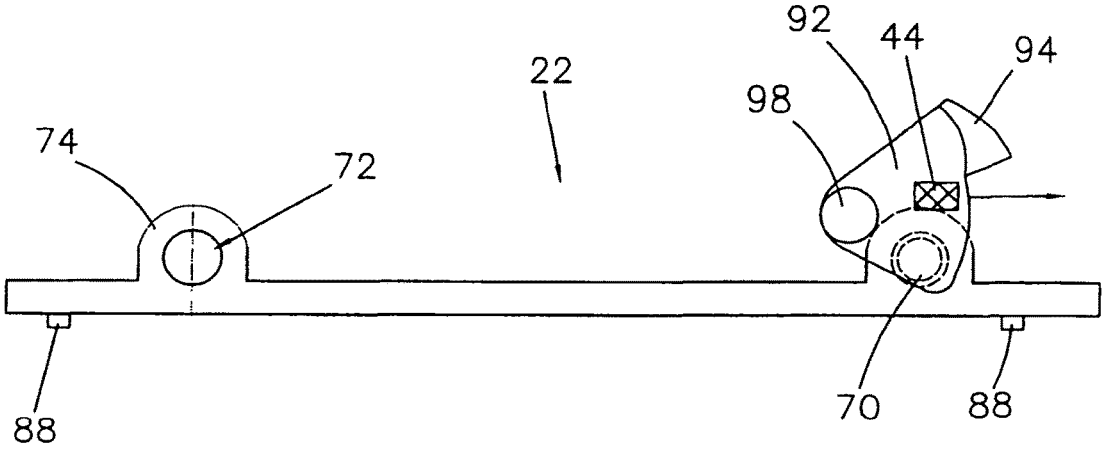
FIG. 3 is a top view of the lock subassembly of the double lock, dual action gravity latch device of the present invention in the unlocked position.
Figure 4:
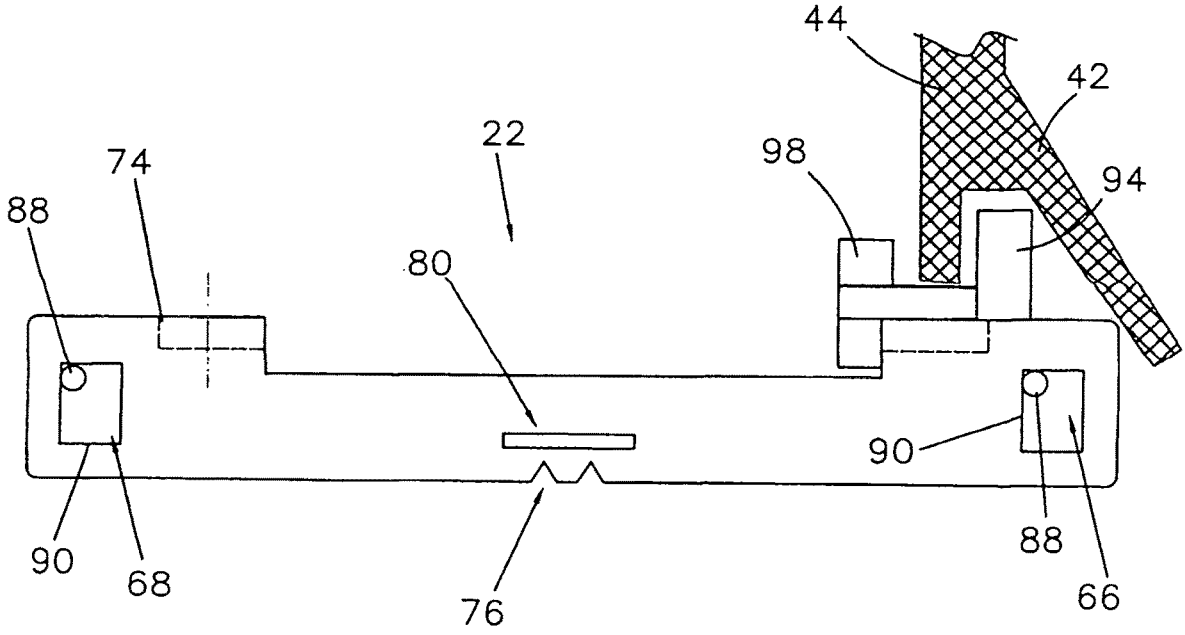
FIG. 4 is a side view of the lock subassembly of the double lock, dual action gravity latch device of the present invention in the unlocked position.
Figure 10:
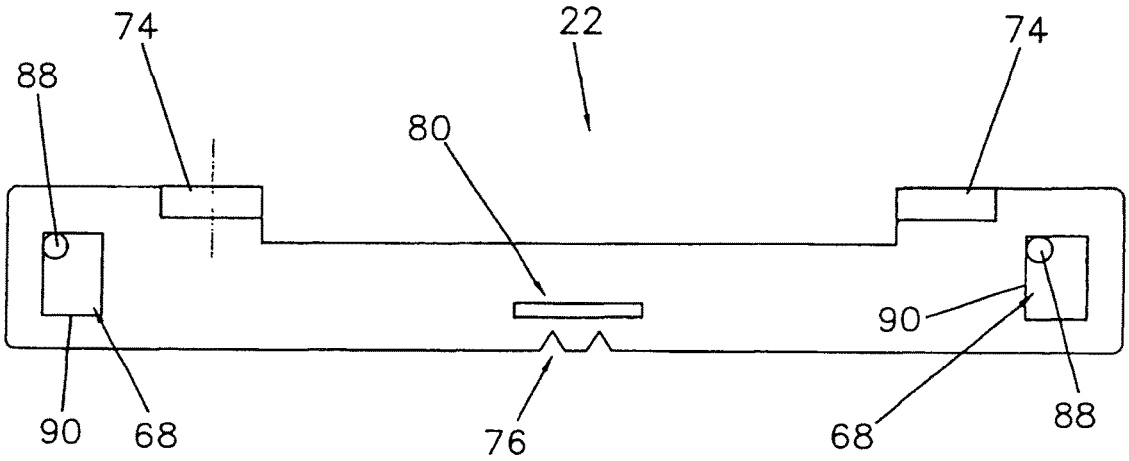
FIG. 10 is a side view of the lock bar or member of the double lock, dual action gravity latch device of the present invention in the unlocked position.
Figure 15:
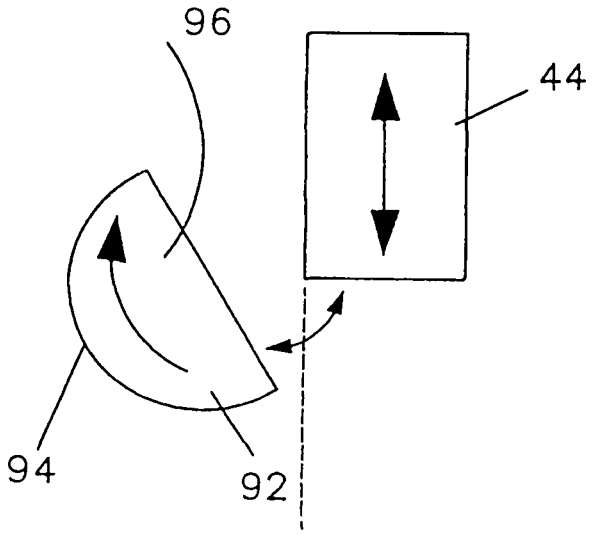
FIG. 15 is a top schematic view of the pivotal latch member and cam member or latch stop of the double lock, dual action gravity latch device of the present invention with the cam member or latch stop in the unlocked position.

To move the lock assembly and lock subassembly of the latch lock assembly from the locked position (FIG. 12) to the unlocked position (FIG. 10), the cylinder 82 of either of the locks 18 or 20 is rotated, first or proximal lock 18 shown, from the locked position to unlocked position moving the corresponding pin 88 against the inner periphery or perimeter 90 of the corresponding bar actuator aperture or recess 66 (FIG. 13) moving or sliding the lock bar or member 22 linearly to rotate the lock cam or latch stop 24 to the unlocked position as shown in FIGS. 3, 4 and 15 allowing the pivot latch member 12 to rotate passed the lock cam or latch stop 24 permitting the gate or door (not shown) to be opened. To remove the key (not shown) when the lock assembly and lock subassembly are in the intermediate unlocked position or configuration (FIG. 13), the key (not shown) is rotated in the opposite direction rotating the cylinder 82 and pin 88 to the position as shown in FIG. 10.

Figure 5:
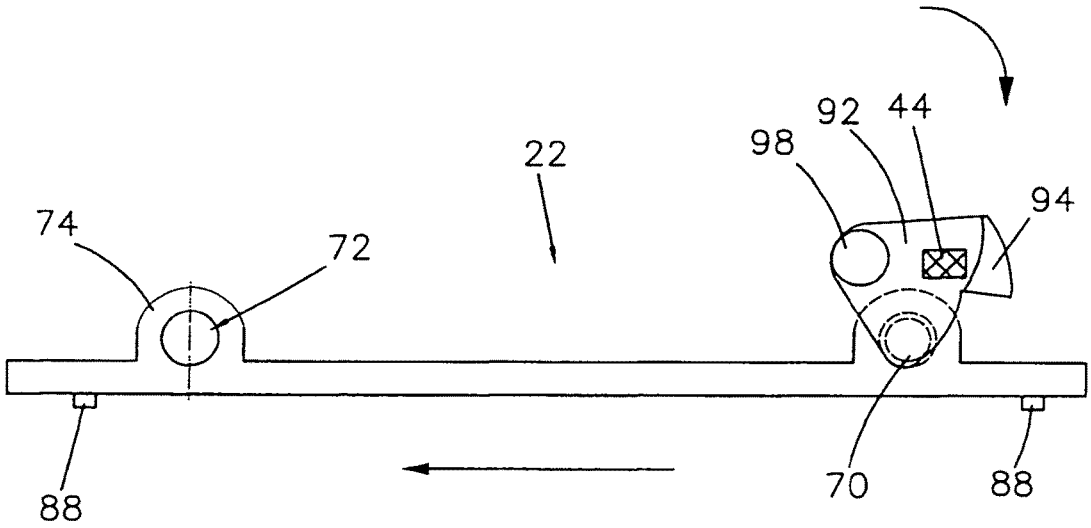
FIG. 5 is a top view of the lock subassembly of the double lock, dual action gravity latch device of the present invention in the locked position.
Figure 6:
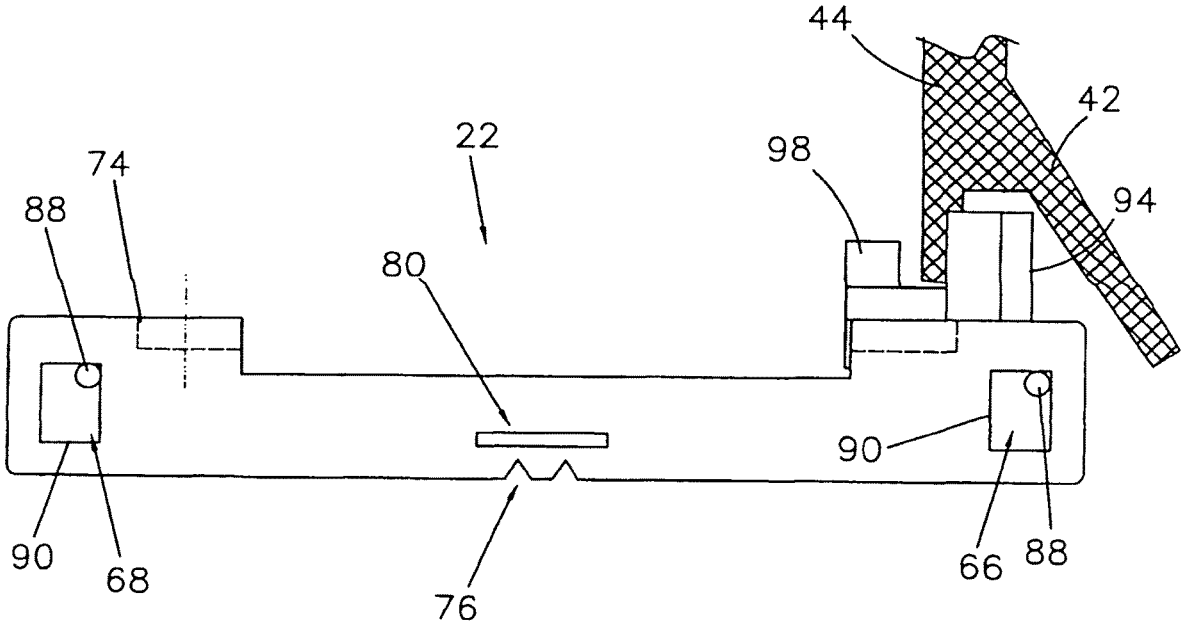
FIG. 6 is a side view of the lock subassembly of the double lock, dual action gravity latch device of the present invention in the locked position.
Figure 7:
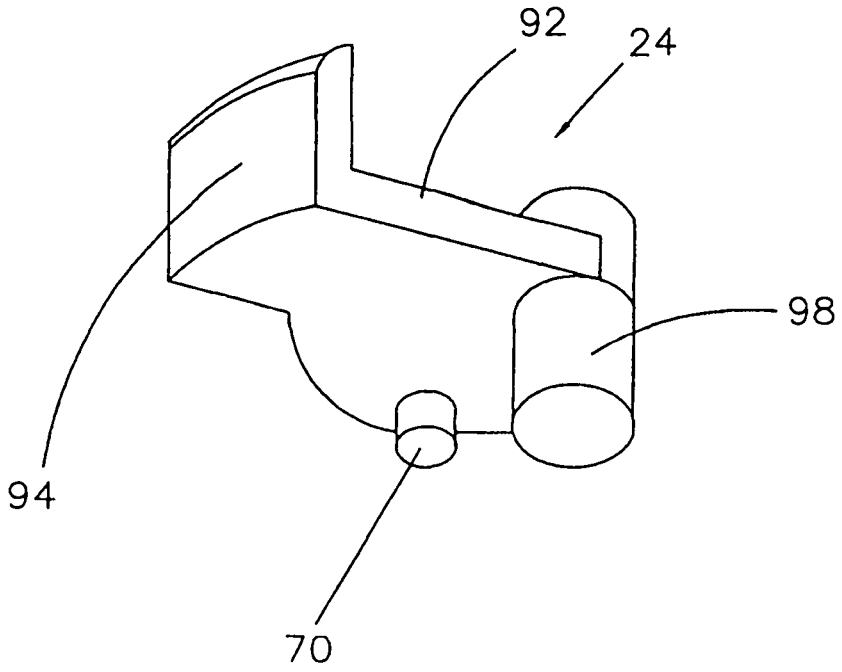
FIG. 7 is a bottom perspective view of the lock cam or latch stop of the double lock, dual action gravity latch device of the present invention.
Figure 8:
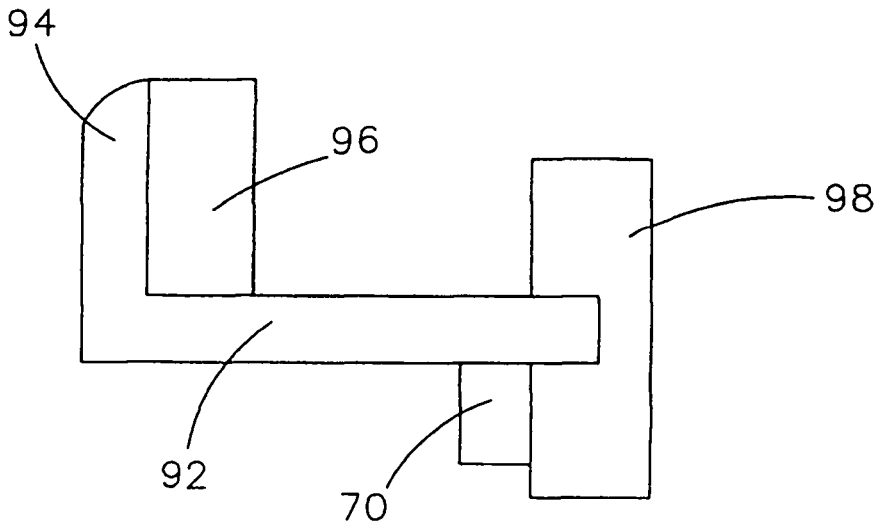
FIG. 8 is a side view of the lock cam or latch stop of the double lock, dual action gravity latch device of the present invention.
Figure 9:
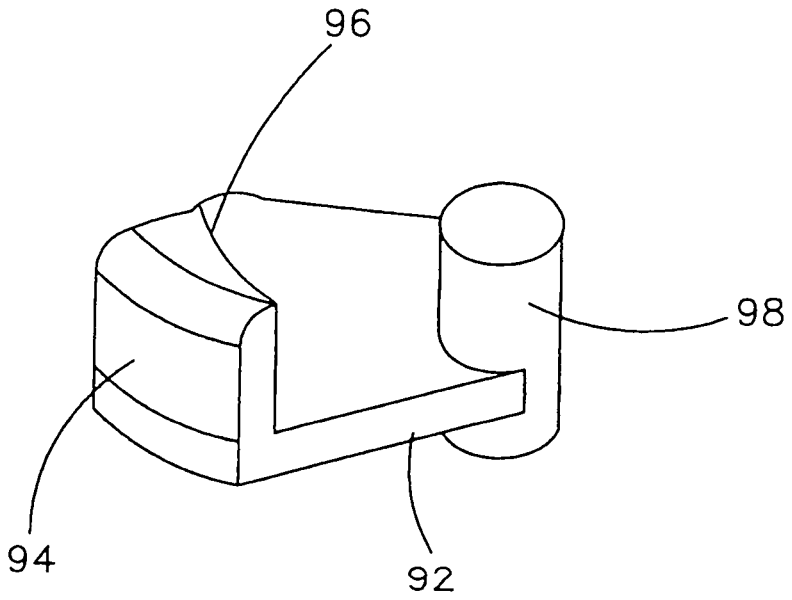
FIG. 9 is a top perspective view of the lock cam or latch stop of double lock, dual action gravity latch device of the present invention.
Figure 11:
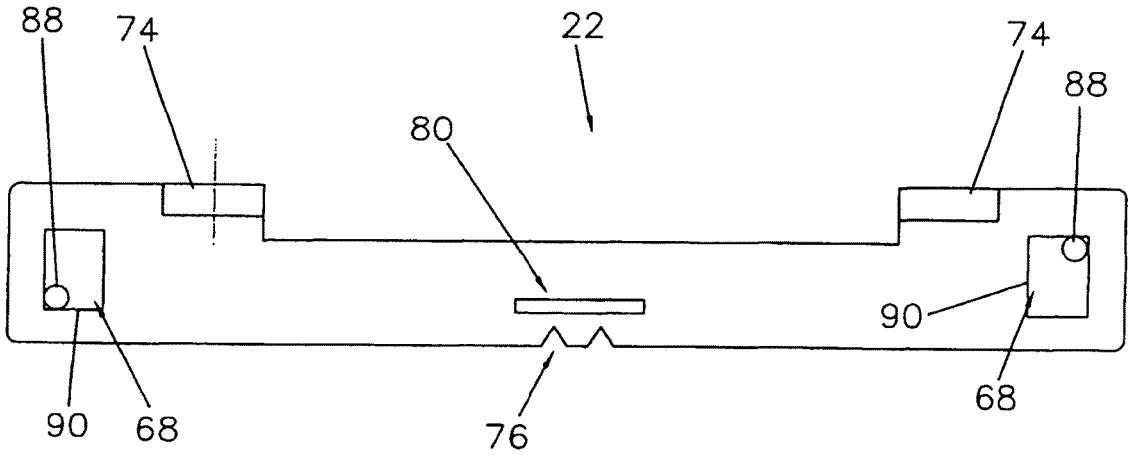
FIG. 11 is a side view of the lock bar or member of the double lock, dual action gravity latch device of the present invention in the intermediate locked position.
Figure 12:
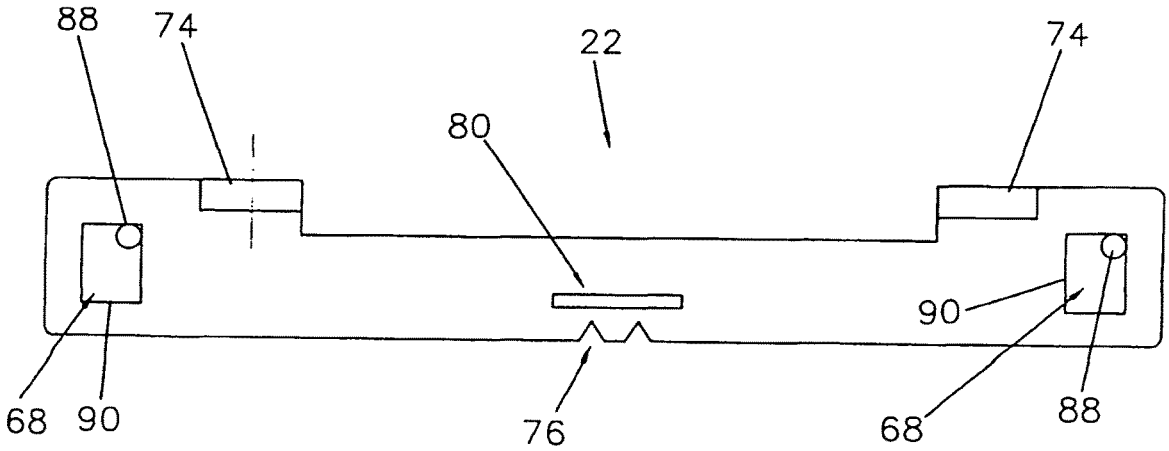
FIG. 12 is a side view of the lock bar or member of the double lock, dual action gravity latch device of the present invention in the locked position.
Figure 13:
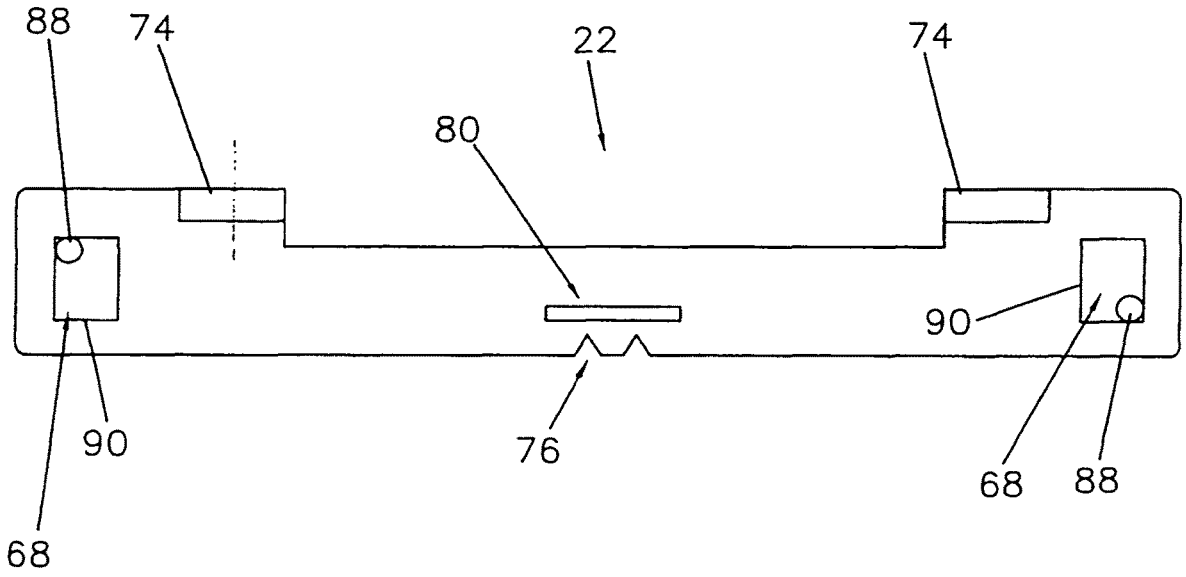
FIG. 13 is a side view of the lock bar or member of the double lock, dual action gravity latch device of the present invention in the intermediate unlocked position.

In a similar manner, to move the lock assembly and lock subassembly of the latch lock assembly from the unlocked position (FIG. 10) to the locked position (FIG. 12), the cylinder 82 of either of the locks 18 or 20 is rotated, second or distal lock 20 shown, from the unlocked position to the locked position moving the corresponding pin 88 against the inner periphery or perimeter 90 of the corresponding bar actuator aperture or recess 66 (FIG. 11) moving or sliding the lock bar or member 22 linearly to rotate the cam or latch stop 24 to the locked position as shown in FIGS. 5, 6 and 14 blocking the pivot latch member 12 from rotating past the lock cam or latch stop to prevent the gate or door (not shown) from opening. To remove the key (not shown) when the lock assembly and lock subassembly are in the intermediate locked position or configuration (FIG. 11), the key (not shown) is rotated in the opposite direction rotating the cylinder 82 and pin 88 to the position as shown in FIG. 12.

The key (not shown) may only be removed from the lock 18 or 20 once the key (not shown) is rotated back to the neutral position.

FIGS. 19 through 28 depict an alternate embodiment of the double lock, dual action gravity latch device comprising a latch assembly generally indicated as 10 including a pivotal latch member generally indicated as 12 mounted to a fence post 13 and a keeper assembly generally indicated as 14 including a striker pin 16 attached to a gate frame 15 to selectively engage the pivotal latch member 12 to selectively maintain the gate (not shown) in the closed position.

The latch assembly 10 comprises a latch lock assembly including a latch lock housing generally indicated as 26 to receive and support a first or proximal lock generally indicated as 18 and a second or distal lock generally indicated as 20 each independently movable between a locked position and an unlocked position disposed on the proximal side and distal side of the fence post 13 respectively and a latch blocking assembly including a blocking member generally indicated as 22 selectively movable between a blocking position (FIG. 26) and an unblocking position (FIGS. 27 and 28) to selectively block movement of the pivotal latch member 12 from the latched position to the unlatched position when the first or proximal lock 18 and the second or distal lock 20 are each in the locked position and having a blocking plate 24 formed on the proximal end portion thereof.

The latch assembly 10 further comprises a first latch actuator housing generally indicated as 21 including a slot 23 to receive at least a portion of the pivotal latch member 12 therethrough and a keeper receiver opening 28 to receive the striker pin 16 of the keeper assembly 14 when the gate (not shown) is closed. A side housing cover or plate generally indicated a 30 is secured to the latch lock housing 26 by a plurality of fasteners each indicated as 32 extending through corresponding apertures 34 formed in the side housing cover or plate 30 and into corresponding apertures or recesses (not shown) formed in the latch housing 26. The vertical profiles of the latch lock housing 26 and the side housing cover or plate 30 are symmetrical.

Figure 24:
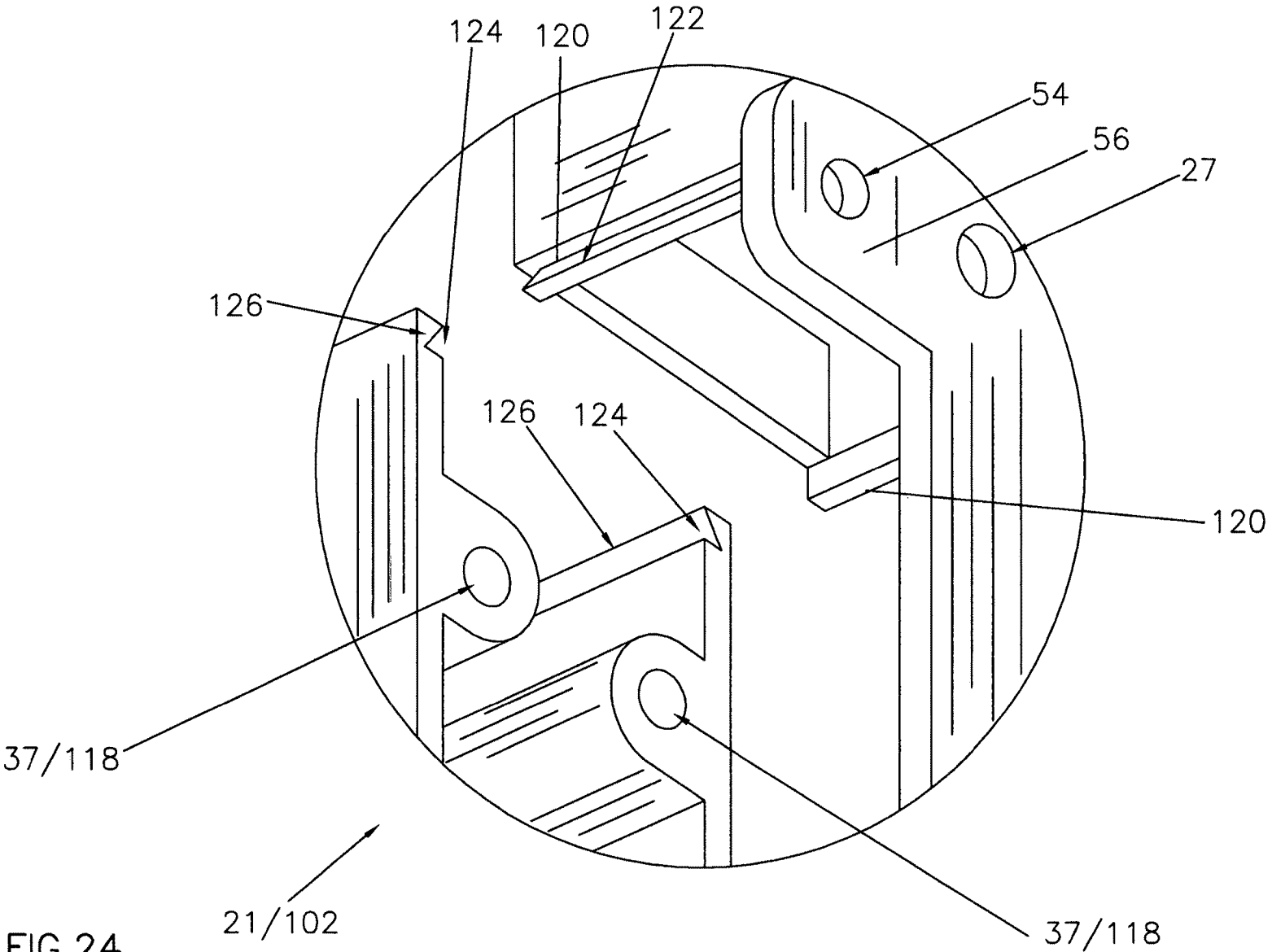
FIG. 24 is a detailed view of the latch housing retainer of the alternate embodiment of the present invention.
Figure 25:
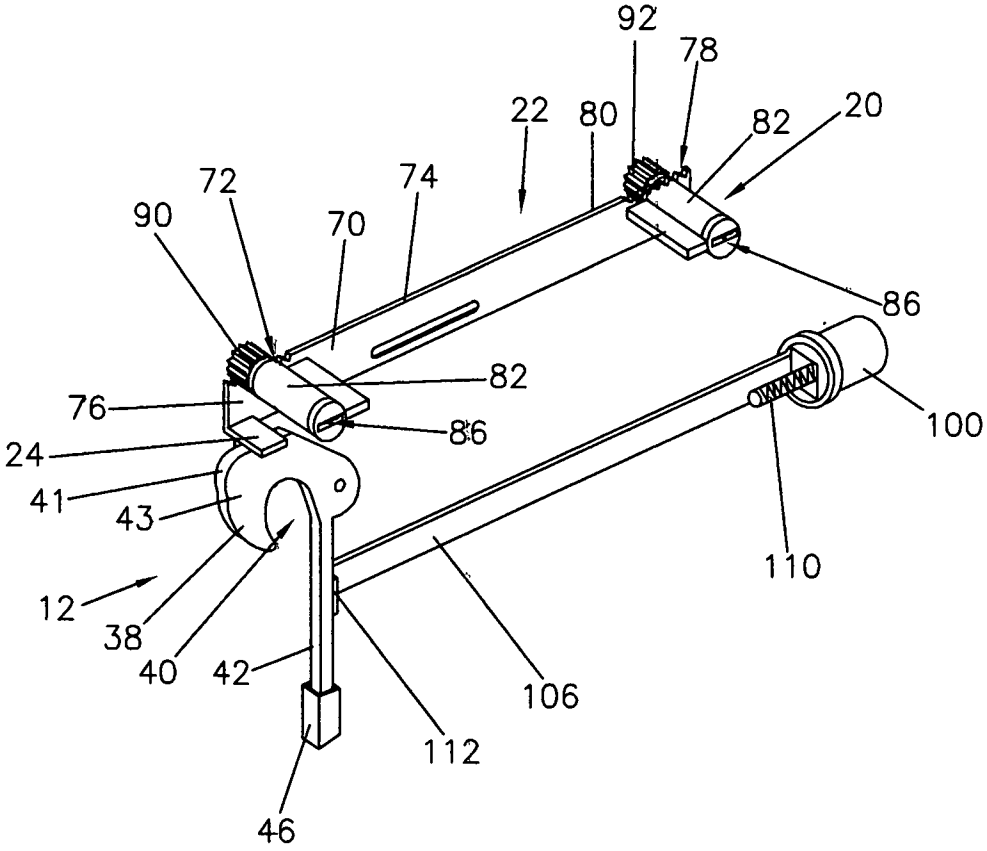
FIG. 25 is a perspective view of the first latch lock assembly and second latch actuator assembly of the alternate embodiment of the present invention.

The first latch actuator housing 21 is attached or fastened to the first or proximal end portion of the latch lock housing 26 by fasteners 25 extending through corresponding holes 27 formed on a first or proximal end plate 29 and into holes or recesses 37 formed in the first latch actuator housing 21 (FIG. 24).

The pivotal latch member 12 comprises an upper hook shaped member 38 including a striker pin recess 40 normally disposed within the keeper receiver opening 28 when in the latched position due to gravity, a latch member 42 extending downward from the upper hook shaped member 38. A substantially flat blocking surface 41 is formed on the upper portion 43 of the pivot latch member 12; while a latch knob 46 may be formed on the lower portion of the latch member 42. The pivotal latch member 12 is pivotally mounted within the latch housing 26 on a latch mounting pin 48 extending through a pivot aperture 50 formed on the pivotal latch member 12 and into a mounting pin hole or recess 52.

The latch assembly 10 is affixed to the fence post 13 with fasteners 53 passing through holes 54 formed through mounting flanges each indicated as 56. In addition, at least one hole 55 may be formed through the sides 57 of the latch assembly 10 to secure the mid-portion thereof to the fence post 13.

Figure 19:
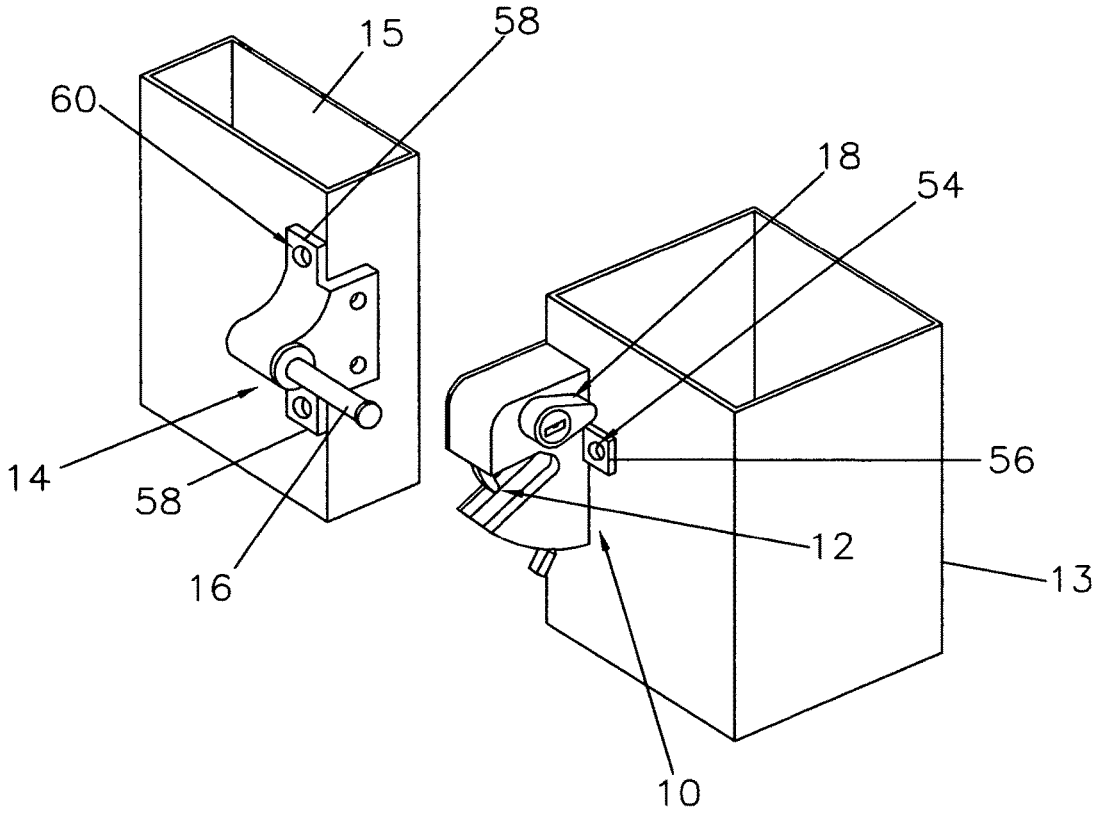
FIG. 19 is a front perspective view of an alternate embodiment of the double lock, dual action gravity device of the present invention.
Figure 20:
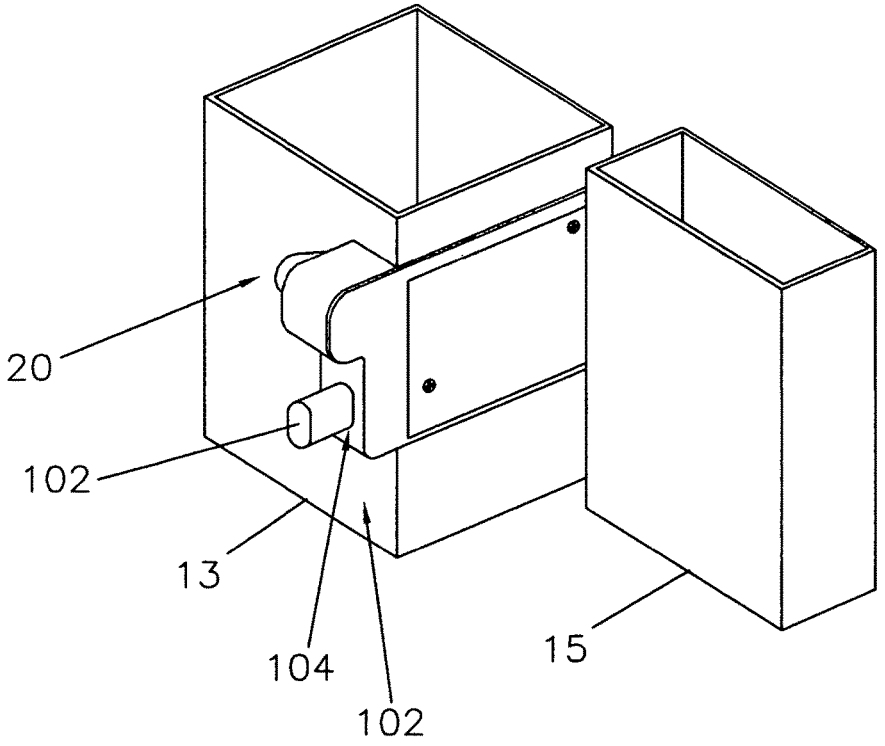
FIG. 20 is a rear perspective view of the alternate embodiment of the double lock, dual action gravity device of the present invention.
Figure 21:
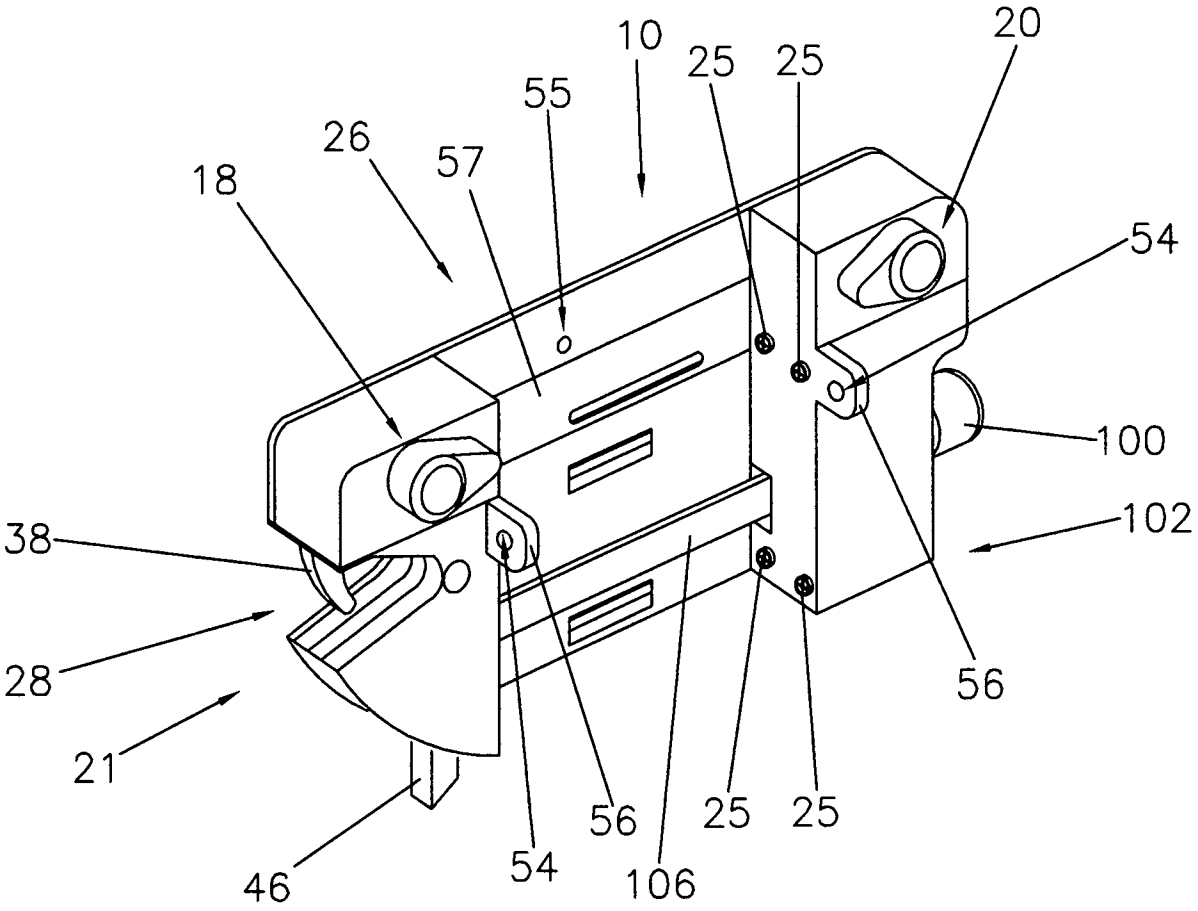
FIG. 21 is a side view of the latch assembly of the alternate embodiment of the present invention.
Figure 22:
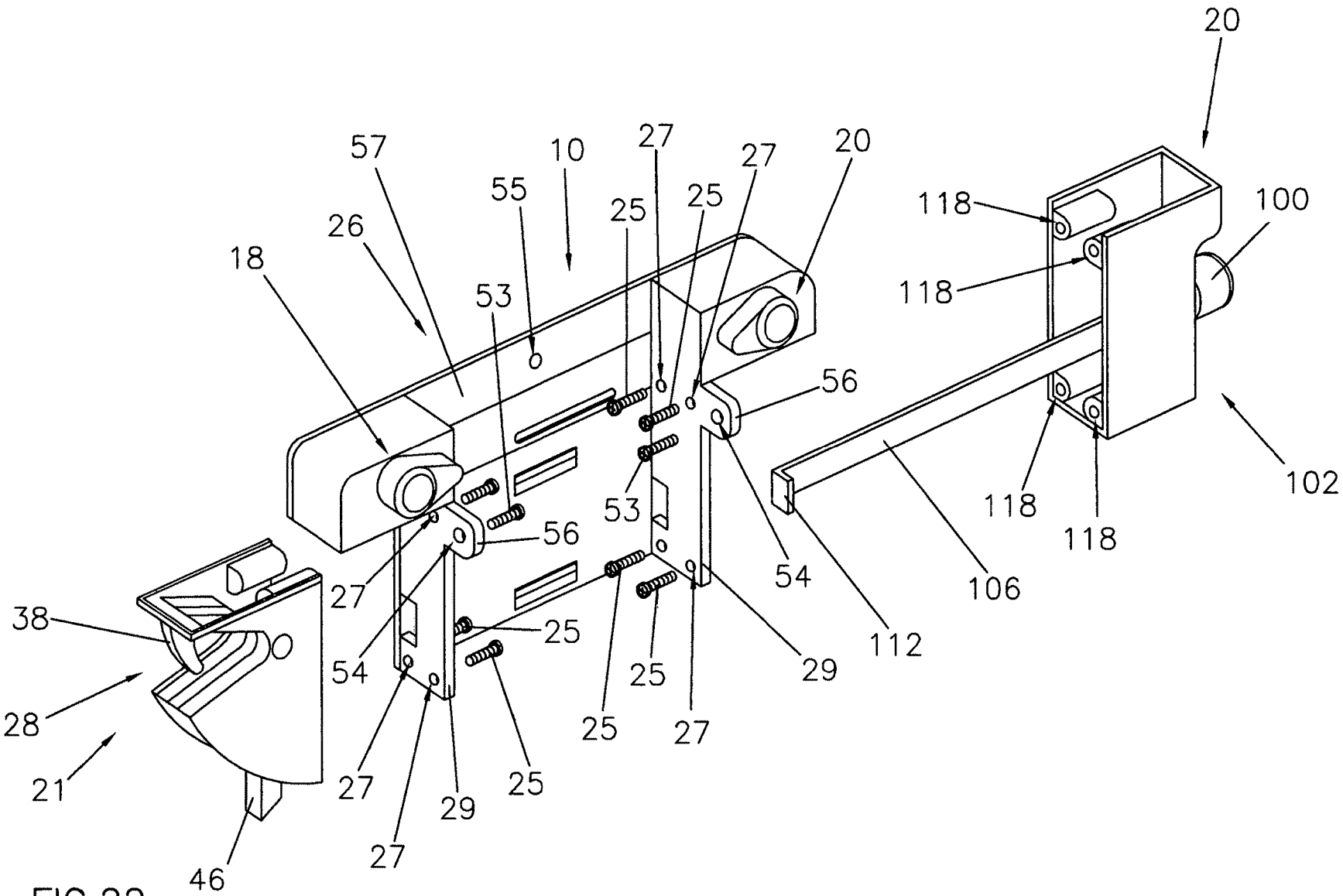
FIG. 22 is an exploded side view of the latch assembly of the alternate embodiment of the present invention.
Figure 23:
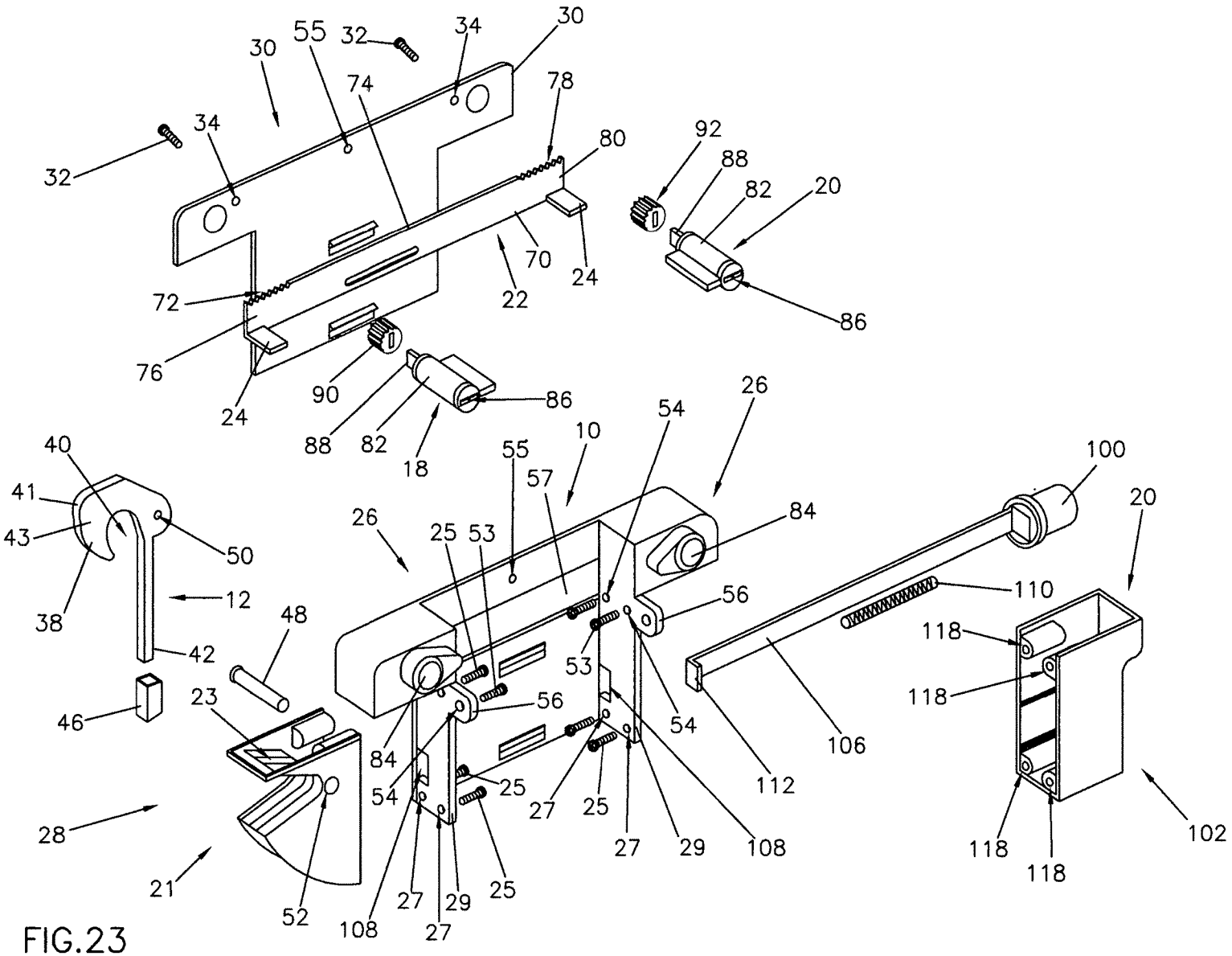
FIG. 23 is an exploded perspective view of the latch assembly of the alternate embodiment of the present invention.

As shown in FIG. 19, the keeper assembly 14 is affixed to the gate frame 15 by an upper and lower front attachment flange each indicated as 58 including corresponding holes 60 by fasteners such as screws 62.

The blocking member 22 comprises a substantially flat elongated bar 70 having a first or proximal plurality of teeth generally indicated as 72 formed on the upper surface 74 of the proximal end portion 76 thereof and a second or distal plurality of teeth generally indicated as 78 formed on the upper surface 74 of the distal end portion 80 thereof.

The first or proximal lock 18 and the second or distal lock 20 each comprises a three (3) position cylinder 82 disposed within a corresponding sleeve 84 and having a keyway or key slot 86 formed on the outer portion thereof to receive a key (not shown) therein to rotate the cylinder lock 80 between the three (3) positions unlocked position and locked position and neutral position. A mounting member 88 extends outwardly from each cylinder or lock 82 to operatively support a first or proximal gear 90 and second or distal gear 92 respectively thereon.

The first or proximal gear 90 is disposed to engage the first or proximal plurality of teeth 72; while the second or distal gear is disposed to engage the second or distal plurality of teeth 78. The first or proximal gear 90 and the first or proximal plurality of teeth 72 cooperatively form a proximal blocking member actuator and the second or distal gear 92 and the second or distal plurality of teeth 78 to cooperatively form a distal blocking member actuator to move or slide the substantially flat elongated bar 70 linearly moving the blocking plate 24 between a blocking position (FIG. 26) and an unblocking position (FIGS. 27 and 28) as a key (not shown) rotates the cylinder 82 of either the first or proximal lock 80 or the second or distal lock 82.

When in the locked position the latch blocking assembly is disposed in the blocking position (FIG. 27) such that the blocking plate 24 formed on the proximal end portion of the blocking bar 22 will engage the substantially flat block engaging surface 41 formed on the upper portion 43 of the pivotal latch member 12 to prevent the pivotal latch member 12 from rotating to the unlatched position to prevent the gate (not shown) from opening.

The latch knob 46 and the first latch member 42 of the pivotal latch member 12 comprise a first latch actuator to selectively move the pivotal latch member 12 from the latched position to the unlatched position.

A second latch actuator comprises a plunger 100 mounted on the latch lock housing 26 by a second latch actuator housing generally indicated as 102 disposed inside the periphery of an outer plunger opening 104, an elongated actuator bar 106 extending inwardly from the plunger 100 through opening 108 formed in the proximal end plate 29 and distal end plate 29 and a bias or spring 110 partially disposed within the latch housing 26 to engage the distal end plate 29 to normally maintain the second actuator assembly in the first position. An actuator member 112 is formed on the proximal end portion of the elongated actuator bar 114 to engage the pivotal latch member 12 when the plunger 106 is moved inwardly against the force of the bias or spring 116 when the latch assembly is in the unlocked position to pivot the pivot latch member 12 to the open position allowing the gate to be opened. When the plunger 100 is released, the bias or spring 110 returns the second latch actuator to the first or extended position allowing the pivoted latch member 12 to return to the first position.

The second latch actuator housing 102 is attached or fastened to the second or distal end portion of the latch lock housing 26 by fasteners 25 extending through the corresponding holes 27 formed on the second or distal end plate 29 and into holes or recesses 118 formed in the second actuator housing 102.

As shown in FIG. 24, each end portion of the latch lock housing 26 includes a housing retainer protrusion 120 formed on each side thereof and having a diagonal inclined surface 122 to receive and operatively mate with a corresponding retainer groove 124 having a diagonal incline surface 126 formed on each side of the first latch actuator housing 21 and the second latch actuator housing 102 includes a retainer groove 124 formed on each side thereof and having a diagonally inclined surface 126 to engage the diagonal surface 122 of the corresponding housing retainer protrusion 120 to attach or mount the first latch actuator housing 21 and the second latch actuator housing 102 to opposite ends of the latch lock housing 26.

The horizontal distance between the upper recesses or holes 37 relative to each other and horizontal distance between the lower recesses or holes 37 relative to each of the first latch actuator housing 21, and the vertical distance between the upper recesses or holes 37 and lower recesses or holes 37 on each side of the first latch actuator housing 21 are substantially equal to the horizontal distance between the upper recesses or holes 37 relative to each other and horizontal distance between the lower recesses or holes 37 relative to each of the second latch actuator housing 102, and the vertical distance between the upper recesses or holes 37 and lower recesses or holes 37 on each side of the second latch actuator housing 102 respectively.

Since the vertical profiles of the latch lock housing 26 and the side housing cover or plate 30 are substantially symmetrical and the holes or recesses of the first latch actuator housing 21 and the second latch actuator housing 102 are substantially symmetrically configured or distanced, the first latch actuator housing 21 and the second latch actuator housing 102 may be attached to either end of the latch lock housing 26.

Figures 26, 27, 28:
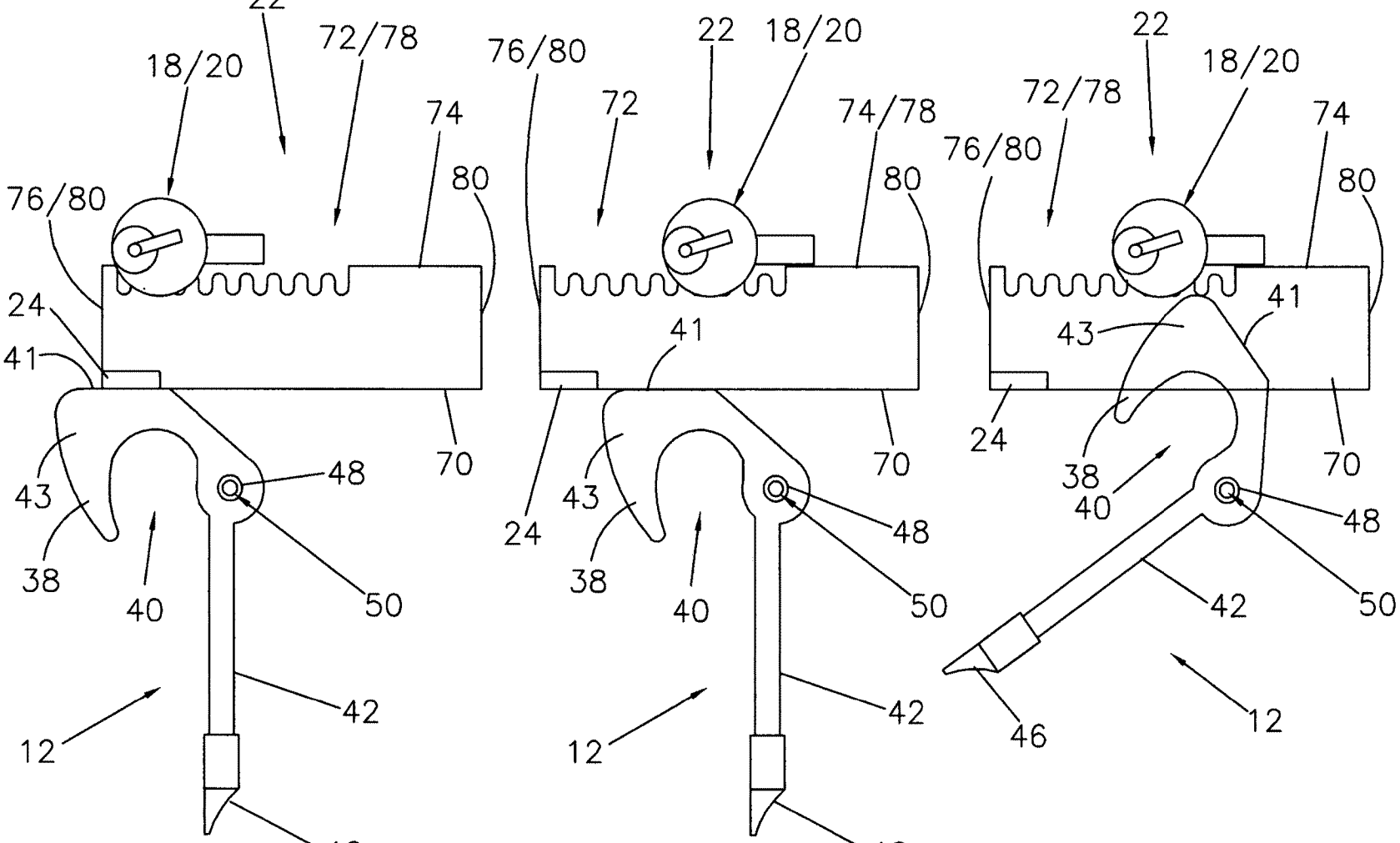
FIG. 26 is a partial side view of the lock bar or member of the alternate embodiment of the present invention in the locked position.
FIG. 27 is a partial side view of the lock bar or member of the alternate embodiment of the present invention in the unlocked position with the gravity latch in the latched position.
FIG. 28 is a partial side view of the lock bar or member of the alternate embodiment of the present invention in the unlocked position with the gravity latch in the unlatched position.

In summary, to move the lock assembly and lock subassembly of the latch lock assembly from the locked position to the unlocked position the cylinder 82 of either lock 18 or 20 is rotated from the locked position to unlocked position rotating the corresponding pin 88 and gear 90 or 92 sliding the blocking member 22 linearly to move the blocking plate 24 to the unblocking position shown in FIGS. 27 and 28 allowing the pivot latch member 12 to rotate permitting the gate or door (not shown) to be opened.

In a similar manner, to move the lock assembly and lock subassembly of the latch lock assembly from the unlocked position shown in FIGS. 27 and 28 to the locked position shown in FIG. 26, the cylinder 82 is rotated from the unlocked position to the locked position moving the corresponding pin 88 and gear 90 or 92 or sliding the blocking member 22 linearly to move the blocking plate 24 to the locked position shown in FIG. 26 blocking the pivot latch member 12 from preventing the gate or door (not shown) from opening.

The key (not shown) may only be removed from the lock 18 or 20 once the key (not shown) is rotated back to the neutral position.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

In describing the invention, certain terms are used for brevity, clarity, and understanding. No unnecessary limitations should be inferred beyond the requirement of the prior art because such terms are used for descriptive purposes and are intended to be broadly construed. The different structural and functional elements, apparatuses, devices, compositions, and methods described herein may be used alone or in combination with other structural and functional elements, apparatuses, devices, compositions, systems and methods. It is to be expected that various equivalents, alternatives and modifications are possible within the scope of the claims hereinafter.

Now that the invention has been described,

What is claimed is:

1. A dual action gravity latch device to secure a gate in a closed position to block the opening or portal in a fence comprising a latch assembly including a first lock and a second lock disposed on opposite sides of the gate and a pivotal latch member movable between a latched position and an unlatched position, a keeper assembly including a striker pin to maintain the gate in the closed position when said pivotal latch member in said latched position, a first actuator assembly and a second actuator assembly each movable between a first position or configuration and a second position or configuration disposed on opposite sides of the gate to selectively engage said pivotal latch member when either said first lock or said second lock is in an unlocked position such that when said first actuator assembly is moved from said first position or configuration to said second position or configuration said first actuator assembly moves said pivotal latch member from said latched position to said unlatched position to allow the gate to be opened and when said second actuator assembly is moved from said first position or configuration to said second position or configuration said second actuator assembly moves said pivotal latch member from said latched position to said unlatched position to allow the gate to be opened and further including a latch blocking assembly selectively movable between a blocking position and an unblocking position to prevent said pivotal latch member from moving from said latched position to said unlatched position when said latch blocking assembly is in said blocking position, said latch blocking assembly includes a blocking member selectively movable between said blocking position and said unblocking position to selectively prevent movement of said pivotal latch member from moving from said latched position to said unlatched position when in said blocking position wherein said blocking member comprises an elongated bar having a first or proximal plurality of teeth formed on a proximal end portion thereof and a second or distal plurality of teeth formed on a distal end portion thereof and said first or proximal lock and said second or distal lock each selectively movable between a locked position and an unlocked position and having a first or proximal gear and second or distal gear coupled thereto respectively, said first or proximal gear is disposed to engage the first or proximal plurality of teeth and said second or distal gear is disposed to engage the second or distal plurality of teeth such that said first or proximal gear and said first or proximal plurality of teeth cooperatively form a proximal blocking member actuator and said second or distal gear and said second or distal plurality of teeth to cooperatively form a distal blocking member actuator to selectively slide said elongated bar linearly moving said blocking member between said blocking position and said unblocking position when said first or proximal lock is moved from said locked position to said unlocked position or when said second or distal lock is moved from said locked position to said unlocked position respectively.

2. The dual action gravity latch of claim 1 wherein said latch blocking assembly further includes a blocking plate formed on said proximal end portion of said blocking bar disposed to engage said pivotal latch member to prevent rotation of said pivotal latch member to said unlatched position when said blocking member is in said blocking position.

* * * * *